US010384242B2

(12) United States Patent
Das et al.

(10) Patent No.: US 10,384,242 B2
(45) Date of Patent: Aug. 20, 2019

(54) SLUDGE MANAGEMENT SYSTEM FOR CRUDE OIL STORAGE TANKS

(71) Applicant: CONOCOPHILLIPS COMPANY, Houston, TX (US)

(72) Inventors: Sandipan Kumar Das, Owasso, OK (US); Sally Ann Thomas, Bartlesville, OK (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 15/066,925

(22) Filed: Mar. 10, 2016

(65) Prior Publication Data

US 2016/0263633 A1 Sep. 15, 2016

Related U.S. Application Data

(60) Provisional application No. 62/130,984, filed on Mar. 10, 2015.

(51) Int. Cl.
*B08B 9/093* (2006.01)

(52) U.S. Cl.
CPC ..... *B08B 9/0933* (2013.01)

(58) Field of Classification Search
None
See application file for complete search history.

(56) References Cited

U.S. PATENT DOCUMENTS 4,407,678 A 10/1983 Furness
4,828,625 A * 5/1989 Moran ..... B08B 9/0933 134/168 R
2007/0206438 A1 9/2007 Dorsch

FOREIGN PATENT DOCUMENTS

WO 2014001551 1/2014

OTHER PUBLICATIONS

International Search Report for parent case, App. No. PCT/US2016/021837, dated Jun. 6, 2016.

* cited by examiner

*Primary Examiner* — Nicole Blan
(74) *Attorney, Agent, or Firm* — Boulware & Valoir

(57) ABSTRACT

A crude oil storage tank includes a bottom wall, a peripheral wall and a top wall that collectively define a storage volume. A first nozzle is arranged at the peripheral wall. The first nozzle is configured to selectively rotate between a first position and a second position to direct a first stream of fluid into the storage volume. A second nozzle is arranged at the peripheral wall. The second nozzle is configured to selectively rotate between a first position and a second position to direct a second stream of fluid into the storage volume.

6 Claims, 2 Drawing Sheets

SLUDGE MANAGEMENT SYSTEM FOR CRUDE OIL STORAGE TANKS

PRIORITY CLAIM

This application is a non-provisional application which claims benefit under 35 USC § 119(e) to U.S. Provisional Application Ser. No. 62/130,984 filed Mar. 10, 2015, entitled "SLUDGE MANAGEMENT SYSTEM FOR CRUDE OIL STORAGE TANKS," which is incorporated herein in its entirety.

FIELD OF THE INVENTION

This invention relates to systems and processes for managing sludge and, more specifically, a sludge management system for crude oil storage tanks.

BACKGROUND OF THE INVENTION

Crude oil is often stored in large cylindrical storage tanks. The storage tanks may include either a fixed volume or a variable volume. While being stored, various components, such as wax and other particulates entrained in the crude oil may settle and accumulate at a bottom portion of the storage tank. Over time, the wax and/or other particulates may form sludge. The sludge reduces an overall storage capacity of the storage tank and requires numerous maintenance hours to remove.

SUMMARY OF THE INVENTION

In accordance with an aspect of an exemplary embodiment, a crude oil storage tank includes a bottom wall, a peripheral wall and a top wall that collectively define a storage volume. A first nozzle is arranged at the peripheral wall. The first nozzle is configured to selectively rotate between a first position and a second position to direct a first stream of fluid into the storage volume. A second nozzle is arranged at the peripheral wall. The second nozzle is configured to selectively rotate between a first position and a second position to direct a second stream of fluid into the storage volume.

In accordance with another aspect of an exemplary embodiment, a method of reducing sludge deposition in a crude oil storage tank includes directing a first stream of fluid into a storage volume of the crude oil storage tank at a first angle, and directing a second stream of fluid into the storage volume at a second angle. The first and second streams of fluid induce a rotational flow of fluidized sludge in the crude oil storage tank.

BRIEF DESCRIPTION OF THE DRAWINGS

The invention, together with further advantages thereof, may best be understood by reference to the following description taken in conjunction with the accompanying figures by way of example and not by way of limitation, in which.

DETAILED DESCRIPTION OF THE INVENTION

Figure 1:
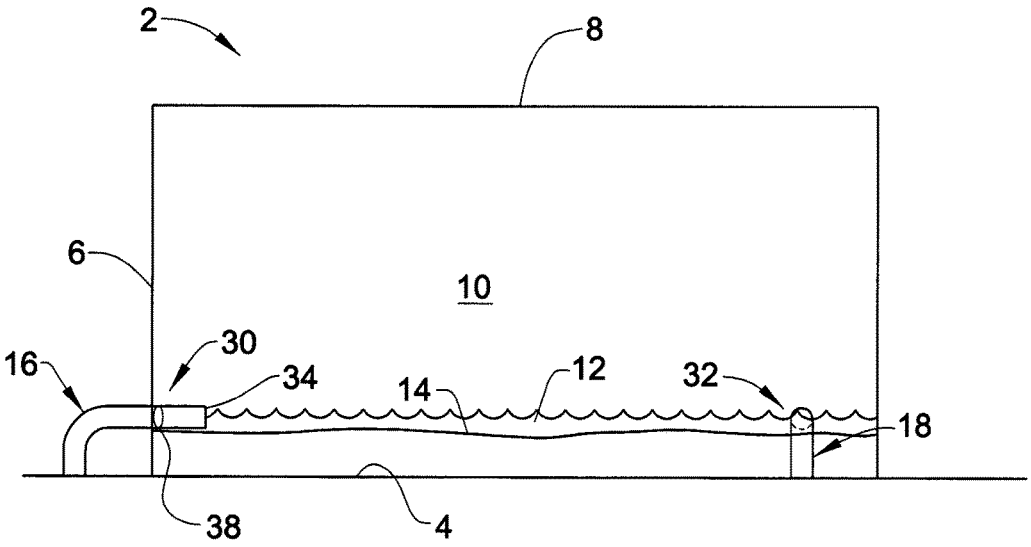
FIG. 1 depicts a side view of a crude oil storage tank including a sludge management system, in accordance with an exemplary embodiment.
Figure 2:
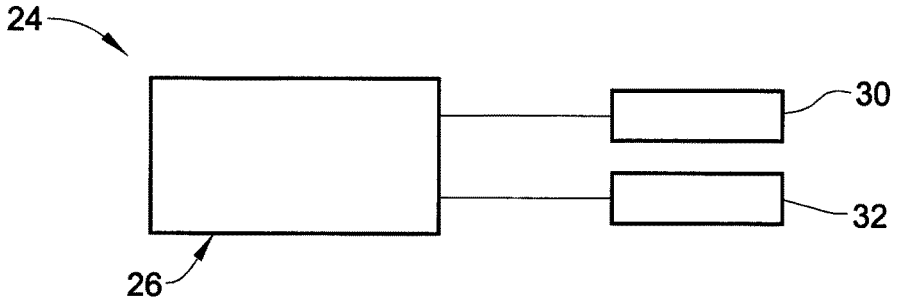
FIG. 2 is a schematic view of the sludge management system of FIG. 1.

A crude oil storage tank is indicated generally at 2 in FIG. 1. Crude oil storage tank 2 includes a bottom wall 4, a peripheral wall 6 and a top wall 8 that collectively define a storage volume 10. A layer of fluid 12 may reside on top of a layer of sludge 14 in storage volume 10. Fluid 12 may take the form of crude oil. Crude oil storage tank 2 includes a first inlet 16, a second inlet 18 and an outlet 20. In accordance with an aspect of an exemplary embodiment, crude oil storage tank 2 includes a sludge management system illustrated generally at 24 in FIG. 2.

Sludge management system 24 introduces fluid, into storage volume 10 in order to induce rotation of fluid 12 and fluidization and rotation of sludge layer 14. The rotation of and fluidization of sludge layer 14 reduces re-sedimentation of materials such as wax and the like. In accordance with an exemplary embodiment, sludge management system 24 includes a controller 26 operatively connected to a first nozzle 30 and a second nozzle 32. First nozzle 30 is arranged at first inlet 16 and second nozzle 32 is arranged at second inlet 18. In accordance with an aspect of an exemplary embodiment, first nozzle 30 is spaced 120° from second nozzle 32. As will be detailed more fully below, controller 24 selectively positions first and second nozzles 30 and 32 to induce a desired rotation of fluid 12.

Figure 3:
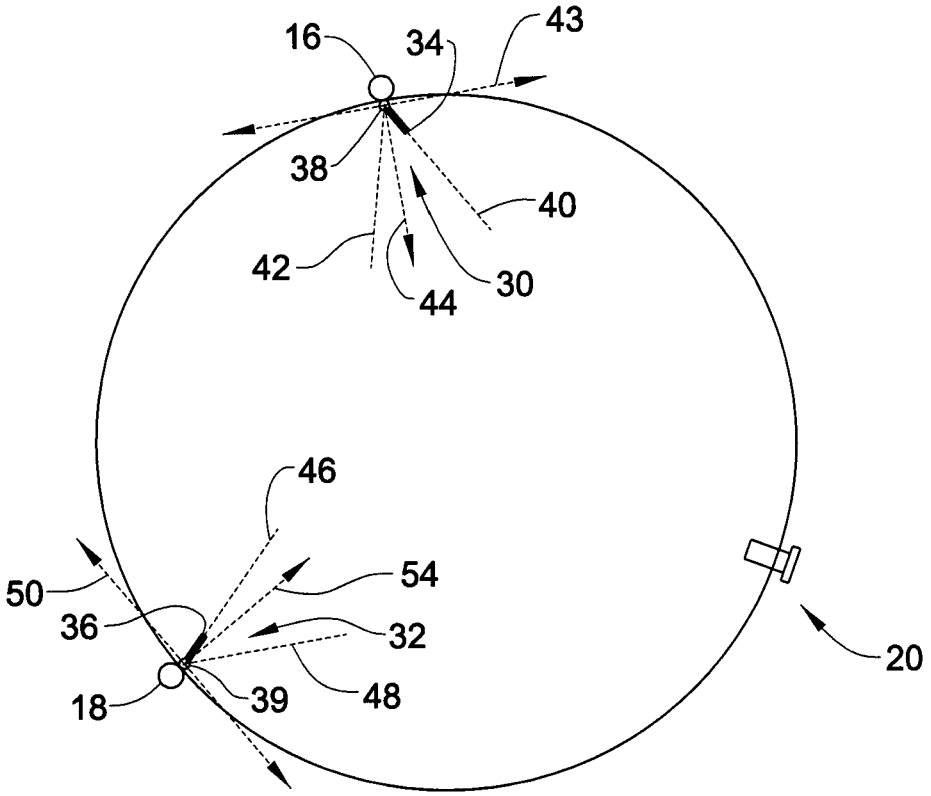
FIG. 3 is a top view of the crude oil storage tank of FIG. 1.

As shown in FIG. 3, first nozzle 30 includes a first outlet 34 and second nozzle 32 includes a second outlet 36. First and second outlets 32 and 36 are selectively positioned to direct a fluid into storage volume 10. In accordance with an aspect of an exemplary embodiment, first and second outlets 32 and 36 have a diameter of about 4-inches (10.16-cm). In accordance with another aspect of an exemplary embodiment, first and second nozzles 30 and 32 are arranged at a height that defines a substantially horizontal plane (not separately labeled). That is, first and second nozzles 30 and 32 are each spaced from bottom wall 4 at a substantially similar height. First nozzle 30 is mounted to a first pivot 38 and second nozzle 32 is mounted to a second pivot 39. In this manner first nozzle 30 may rotate at first pivot 38 between a first position 40 and a second position 42. First position 40 is at an angle about 60° from a first tangent 43 and second position 42 is at an angle of about 75° from first tangent 43 in a direction opposite to that of first position 40. First nozzle 30 is also selectively positionable in a third position 44 that extends along a radius of crude oil storage tank 2. Second nozzle 32 may rotate at second pivot 39 between a first position 46 and a second position 48. First position 46 is at an angle about 75° from a second tangent 50 and second position 48 is at an angle of about 60° from second tangent 50 in a direction opposite to that of first position 46. Second nozzle 32 is also selectively positionable in a third position 54 that extends along radius of crude oil storage tank 2.

In accordance with an aspect of an exemplary embodiment, after introducing fluid 12 into storage volume 10, first and second nozzles 30 and 32 are shifted to the third position 46 and 54 respectively to direct corresponding first and second flows of fluid along a radius of crude oil storage tank 2. The first and second streams of fluid pass substantially simultaneously from respective ones of first and second nozzles 30 and 32 at a velocity of at least about 15 m/s up to a velocity of about 27.4 m/s. Directing the first and second nozzles 30 and 32 along a radius of crude oil storage tank 2 reduces deposits that may reside centrally within storage volume 10 at bottom wall 4. First and second nozzles 30 and 32 may be directed along the radius of crude oil storage tank 2 for a period about 15-20 minutes at a beginning of a sludge management cycle.

After reducing sludge build up from central portions of storage volume 10, controller 24 initiates a second phase of the sludge management cycle by shifting first and second nozzles 30 and 32 to first positions 40 and 46 respectively. At this point, the first and second streams of fluid are directed into storage volume 10 inducing a rotation of fluid 12. The rotation of fluid 12 reduces sludge re-sedimentation and, by extension, sludge build up on bottom wall 4. The second phase of the sludge management cycle will proceed for a selected period. At the end of the selected period, the first and second streams of fluid are stopped allowing any rotation of fluid 12 to slow. Once slowed to a desired momentum, controller 24 shifts first and second nozzles 30 and 32 to second positions 42 and 48 respectively to initiate a third phase of the sludge management cycle. At this point, first and second streams of fluid are reestablished at a velocity of about 15 m/s up to about 27.4 m/s, inducing a counter rotation of fluid 12. The rotation and counter-rotation of fluid 12 reduces sludge build up on bottom wall 4.

In accordance with an aspect of an exemplary embodiment, outlet 20 may be open to allow sludge to continually pass from crude oil storage tank 2. Of course, it should be understood, that outlet 20 may be opened and closed periodically to remove sludge from storage tank 2, or simply opened at a predetermined portion of the sludge management cycle to allow for sludge removal. In addition, it should be understood that first and second nozzles 30 and 32 may introduce first and second streams of heated fluid into storage tank 2 to further promote sludge motility and removal.

At this point it should be understood that the exemplary embodiments describe a system that employs at least two nozzles that direct a fluid flow into a crude oil storage tank to induce a rotation of fluid contained therein. The nozzles are periodically shifted between first and second positions to induce rotation and a counter-rotation of the fluid during a sludge management cycle. A sludge management cycle may occur for a 24-hour period. However, the duration of the sludge management cycle may vary. Also, it should be understood that the number of position shifts during the sludge management cycle may vary. Further, while described as being shifted by a controller, first and second nozzles may also be manually shifted. Finally, it should be understood that the particular angular relationships of the first and second positions may vary.

"About" is intended to include the degree of error associated with measurement of the particular quantity based upon the equipment available at the time of filing the application. For example, "about" can include a range of ±8% or 5%, or 2% of a given value.

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A multi-stage method of reducing sludge deposition in a storage tank, said storage tank comprising a) a bottom wall, b) a peripheral wall, and c) a top wall that collectively define a storage volume, d) a first nozzle arranged at a first inlet through said peripheral wall at a first height, the first nozzle being configured to selectively rotate between a first position and a second position to direct a first stream of fluid into the storage volume, and e) a second nozzle arranged at a second inlet through said peripheral wall at said first height, the second nozzle being configured to selectively rotate between a first position and a second position to direct a second stream of fluid into the storage volume;

said method comprising:

during a first stage, directing first and second streams of fluid into said storage volume along a radius of said storage tank to dislodge sludge that lies centrally;

during a second stage, directing first and second streams of fluid into said storage volume at first and second angles to induce a rotational flow in storage tank to dislodge sludge that lies on said bottom wall;

during a third stage, directing first and second streams of fluid into said storage volume storage volume at third and fourth angles, opposite said first and second angles respectively, to induce a counter-rotational flow in said storage tank to further dislodge sludge that lies on said bottom wall; and removing dislodged sludge from said storage tank.

2. The method of claim 1, wherein said first and second streams of fluid are introduced at a velocity of about 15 m/s up to a velocity of about 27.4 m/s.

3. The method of claim 1, wherein said first, second and third stages vary in duration and number.

4. The method of claim 3, wherein said first and second streams of fluid are introduced at a velocity of at least about 15 m/s up to a velocity of about 27.4 m/s.

5. A multi-stage method of reducing sludge deposition in a storage tank, said storage tank comprising:

a) a bottom wall;

b) a peripheral wall; and c) a top wall that collectively define a storage volume;

d) a first nozzle arranged at a first inlet through said peripheral wall at a first height, the first nozzle being configured to selectively rotate between a first position and a second position to direct a first stream of fluid into the storage volume; and e) a second nozzle arranged at a second inlet through said peripheral wall at said first height and 120° from the first nozzle, the second nozzle being configured to selectively rotate between a first position and a second position to direct a second stream of fluid into the storage volume;

said method comprising:

i) during a first stage, directing first and second streams of fluid into said storage volume along a radius of said storage tank to dislodge sludge that lies centrally;

ii) during a second stage, directing first and second streams of fluid into said storage volume at first and second angles to induce a rotational flow in storage tank to dislodge sludge that lies on said bottom wall;

iii) during a third stage, directing first and second streams of fluid into said storage volume storage volume at third and fourth angles, opposite said first and second angles respectively, to induce a counter-rotational flow in said storage tank to further dislodge sludge that lies on said bottom wall; and iv) removing dislodged sludge from said storage tank.

6. The method of claim 5, wherein the first and second angles are 60° and 75° and the third and fourth angles are 75° and 60°.

* * * * *